US011959369B2

(12) United States Patent
Ramey et al.

(10) Patent No.: US 11,959,369 B2
(45) Date of Patent: Apr. 16, 2024

(54) METHOD FOR SOLUTION MINING AND RECOVERY OF BENEFICIAL MINERALS

(71) Applicants: Max E Ramey, Placitas, NM (US); Sandy K Debusschere, Carlyle (CA); John Sheldon McEwan, Cadiz, KY (US)

(72) Inventors: Max E Ramey, Placitas, NM (US); Sandy K Debusschere, Carlyle (CA); John Sheldon McEwan, Cadiz, KY (US)

( * ) Notice: Subject to any disclaimer, the term of this patent is extended or adjusted under 35 U.S.C. 154(b) by 379 days.

(21) Appl. No.: 17/243,316

(22) Filed: Apr. 28, 2021

(65) Prior Publication Data

US 2022/0349287 A1 Nov. 3, 2022

(51) Int. Cl.

| | |
|---|---|
| ***E21B 43/28*** | (2006.01) |
| ***E21B 43/241*** | (2006.01) |
| ***E21B 43/34*** | (2006.01) |
| ***E21B 43/40*** | (2006.01) |

(52) U.S. Cl.

CPC ..... *E21B 43/241* (2013.01); *E21B 43/35* (2020.05); *E21B 43/40* (2013.01)

(58) Field of Classification Search

CPC ..... E21B 43/241; E21B 43/35; E21B 43/40; E21B 43/28; E21B 43/281; B01D 9/0004

See application file for complete search history.

(56) References Cited

U.S. PATENT DOCUMENTS

| | | | | |
|---|---|---|---|---|
| 9,822,013 | B1 * | 11/2017 | McEwan | F01K 19/00 |
| 2009/0309408 | A1 * | 12/2009 | Bishop | E21B 43/281 299/5 |
| 2011/0175428 | A1 * | 7/2011 | Haugen | E21B 43/28 299/4 |
| 2014/0354032 | A1 * | 12/2014 | Haugen | E21B 7/00 299/4 |
| 2021/0254445 | A1 * | 8/2021 | Goldsmith | E21B 43/30 |

* cited by examiner

*Primary Examiner* — Carib A Oquendo

(74) *Attorney, Agent, or Firm* — Plager Schack LLP; Mark H. Plager; Kara Verryt

(57) ABSTRACT

A method for selective solution mining mineral recovery may include heating a wellfield injection brine to a temperature from about 100° C. to about 250° C.; injecting the heated wellfield injection brine into an underground wellfield to dissolve soluble minerals therein, creating a hot brine solution; removing the hot brine solution from the underground wellfield; and recovering the soluble minerals from the hot brine solution by cooling the hot brine solution to a temperature of from about −10° C. to about 5° C. and causing the soluble minerals to precipitate recovered minerals in a solid form.

9 Claims, 6 Drawing Sheets

METHOD FOR SOLUTION MINING AND RECOVERY OF BENEFICIAL MINERALS

BACKGROUND

The embodiments described herein relate generally to solution mining and recovery of beneficial minerals and, more particularly, to a method utilizing high temperature well field injection temperature in combination with a low temperature mineral recover temperature and a steam and power cogeneration process.

Solution mining is a mining method in which the mining of desired minerals is achieved by the injection of a water, or a lean water solution, underground and into a geological formation that contains a desired soluble mineral in a grade concentration that has been determined to be economically feasible for solution mining. The mineral is dissolved into the water, and the rich water solution flows by pump pressure back to the surface and into a mineral recovery processing plant. A solution mining project can be, and has been, an alternative to conventional underground mining projects in which miners and mining equipment work underground to extract and bring to the surface ore in a solid form.

Solution mining processes typically have lower equipment, personal, and maintenance costs than conventional underground mining. However, the energy requirement of the solution methods can be higher due to the need to pump and heat the injection water. Both the heating and pumping energy requirement is influenced greatly by the water circulation rate required for mining and process recovery. This rate is, in turn, influenced strongly by the mineral concentration difference between the lean water injection solution and the rich mine production water solution exiting the well field. A leaner injection solution and a richer production solution would result in a reduced circulation rate required to meet the desired product production rate. This relationship mathematically increases exponentially with increased concentration difference.

The lean water solution returning to the well field is first heated in a steam heated heat exchanger before being pumped to the well field. The rich production brine from the well field is pumped to the mineral recovery process plant. The process plant typically uses chilled water produced from electrical driven compression chillers (mechanical chillers) or absorption chillers in which steam is used to regenerate the absorbent (absorption chillers).

Sylvinite ore is the most common type of potash containing ore and principally consists of potash minerals sylvinite (KCl) and the mineral halite (NaCl) but can also contain minor amounts of carnallite ($KCl.MgCl.6H_2O$). The potash grade for commercially viable sylvinite mining for potash is typically about 20 wt. % potash with the remainder being principally halite.

Using a detailed mass and energy balance, it has been found that the circulation rate required to achieve a given mineral production rate can be reduced by as much as 27% using a combination of a higher injection temperature (>100° C.) and a lower chiller brine temperature (<5° C.) for minerals that experience an increase in solubility with increased solution temperature. This along with the cogeneration of heat and power significantly reduces both the capital cost and operating cost for the solution mining and recovery of beneficial minerals Therefore, to achieve the maximum reduction in the circulation rate and increase in mined brine recovery, what is needed is a solution mining method that simultaneously increases the lean solvent injection temperature and reduces the mined brine recovery temperature.

SUMMARY

Some embodiments of the present disclosure include a method for selective solution mining mineral recovery. The method may include heating a wellfield injection brine to a temperature from about 100° C. to about 250° C.; injecting the heated wellfield injection brine into an underground wellfield to dissolve soluble minerals therein, creating a hot brine solution; removing the hot brine solution from the underground wellfield; and recovering the soluble minerals from the hot brine solution by cooling the hot brine solution to a temperature of from about −10° C. to about 5° C. and causing the soluble minerals to precipitate recovered minerals in a solid form.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

Figure 1:
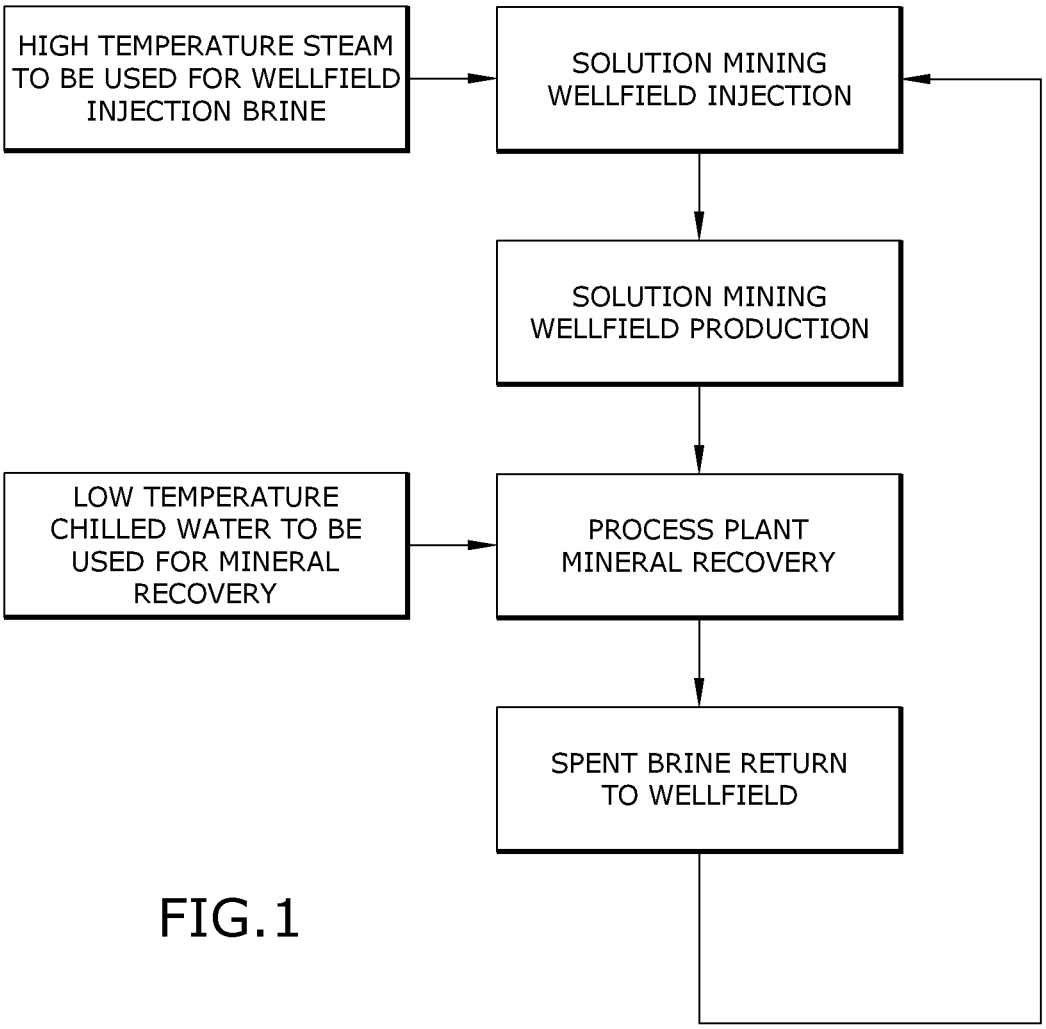
FIG. 1 is a flow chart describing one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The method of the present disclosure may be used to achieve maximum reduction in the circulation rate and increase in mined brine recovery during solution mining and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements and the following examples are presented as illustrative examples only.

As used herein, the following terms and nomenclature have the following definitions:

Solution mine: the wellfield pumping, equipment, and underground caverns as required for solution mining.

Selective solution mining: solution mining to mine only the mineral desired among other soluble minerals in the ore deposit.

Wellfield: the area having one or more underground caverns used for solution mining.

Process plant: the surface equipment facilities engaged in the recovery of solution mined minerals.

Injection solution or injection water: the water or water solution leaving the process plant and pumped to the wellfield for continued solution mining.

Production solution or production brine: the water solution containing dissolved materials leaving the wellfield and returning to the process plant for mineral recovery.

Strong brine or rich water solution: a brine containing a higher concentration of mined minerals.

Weak brine or lean water solution: a brine containing a depleted amount of mined minerals due to mineral recovery.

Return brine: a weak brine returning to the mine wellfield at various points in the process for continued solution mining and mineral fortification.

Ton (t): metric ton, equivalent to 2204.6 pounds.

t/h: metric tons per hour.

t/y: metric tons per year.

TPA: metric tons per annum.

Bar (a): absolute pressure in bars, equivalent to 14.5037 pounds per square inch.

gJ: one billion Joules of energy.

kWh: 1,000 Watt-hours of electrical energy.

By way of example, and referring to FIGS. 1-6, some embodiments of the invention include a High Temperature Solution Mining-Low Temperature Mineral Recovery (HTSM-LTMR) process to decrease the brine concentrations of potassium chloride (KCl) in a weak brine going to a mine wellfield and also to recover KCl more efficiently in the mine production brine, wherein both effects may reduce the brine circulation rate required to meet a desired potash production rate. The process may also result in increased energy and water efficiency as well as improved mine and process plant economics. Specifically, the HTSM-LTMR process of the present disclosure takes advantage of the lower mineral solubility limit produced by the use of chilled water in a crystallization process and the increased concentration of KCl in the production brine from the wellfield. These two simultaneous effects may reduce the circulation rate required to meet a desired production rate, resulting in decreased capital and operative costs and increased energy efficiency.

In embodiments, and as described in FIG. 1, the method of the present disclosure may comprise injecting hot water or an unsaturated hot brine solution into an underground wellfield to dissolve soluble beneficial minerals for recovery in an above ground processing plant. The hot water solution may be heated to, for example, a temperature above about 100° C. Recovering the minerals in the processing plant may include cooling the hot water solution to precipitate the minerals from the solution in a solid form. The solution may be cooled using cooling crystallizer, wherein chillers may be used to provide the cooling for the crystallizers. The chilled water or brine used in the chillers may be cooled to below about 5° C. The circulating spent brine may be returned to the injection heat exchangers to resume mineral mining in the wellfield.

More specifically, the method of the present disclosure may comprise a method for selective solution mining mineral recovery comprising heating a wellfield injection brine using an injection heat exchanger to a temperature of, for example, from about 100° C. to about 250° C., thus increasing mineral solubility in the wellfield, and cooling a resulting weak brine using cooling crystallizer chillers to produce chiller water and/or a salt brine having a temperature of from about −10° C. to about 5° C. The method may further comprise concentrating a soluble product mineral using evaporators in addition to the cooling crystallizers.

Figure 2:
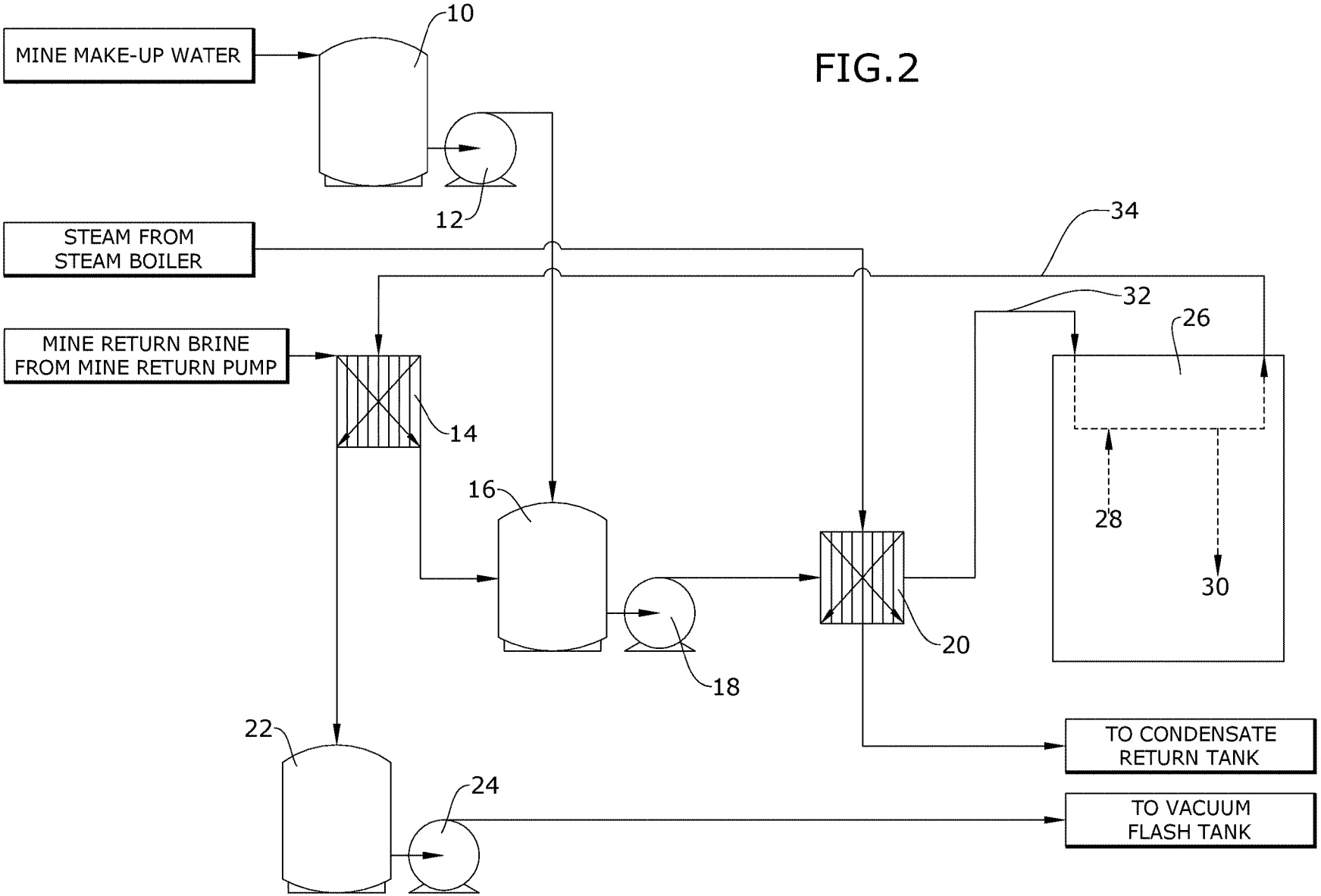
FIG. 2 is a schematic view of one embodiment of the present disclosure.

As shown in more detail in FIG. 2, the method may comprise storing a volume of mine make-up water in a mine make-up water tank 10; pumping the mine make-up water from the mine make-up water tank 10 to a mine return tank 16 using a make-up water pump 12; pre-heating the mine return brine with a production heat exchanger 14, wherein the heated mine return brine is stored in the mine return tank 16 with the make-up water, to eventually be pumped to an injection heat exchanger 20 using mine injection pump 18. The heated mine return brine 32 then flows to the mine cavern 26, causing the creation of a brine solution including dissolved minerals 28 that exits the mine cavern via an exit stream 34 and returns to the production heat exchanger 14 to be pre-cooled and then stored in the cooling crystallizer feed tank 22. Via a crystallizer feed pump 24, the strong brine is pumped to a cooling crystallizer 38. Steam condensate from the injection heat exchanger 20 flows to a condensate return tank 74. Some of the liquid injected into the mine cavern 26 may become mine accumulation water to account for the increased cavern volume due to mineral removal 30. Exchanging heat in the production heat exchanger 14 to pre-cool the strong brine 34 and pre-heat the weak mine return brine results in an energy savings for the process. In embodiments, steam exiting a boiler or exiting a cogeneration turbine/generator may be used to heat the weak brine in the injection heat exchanger 20, such that the weak brine leaving the injection heat exchanger 20 via the stream 32 has a temperature of at least about 100° C. As a result, the production brine leaving the wellfield via the exit stream 34 will have an increased temperature and, hence, an increased KCl solution concentration due to the increased injection temperature. Thus, the method of the present disclosure may result in a heated mine return brine with a greater concentration of minerals being fed into a crystallizer feed tank 22.

Figure 3:
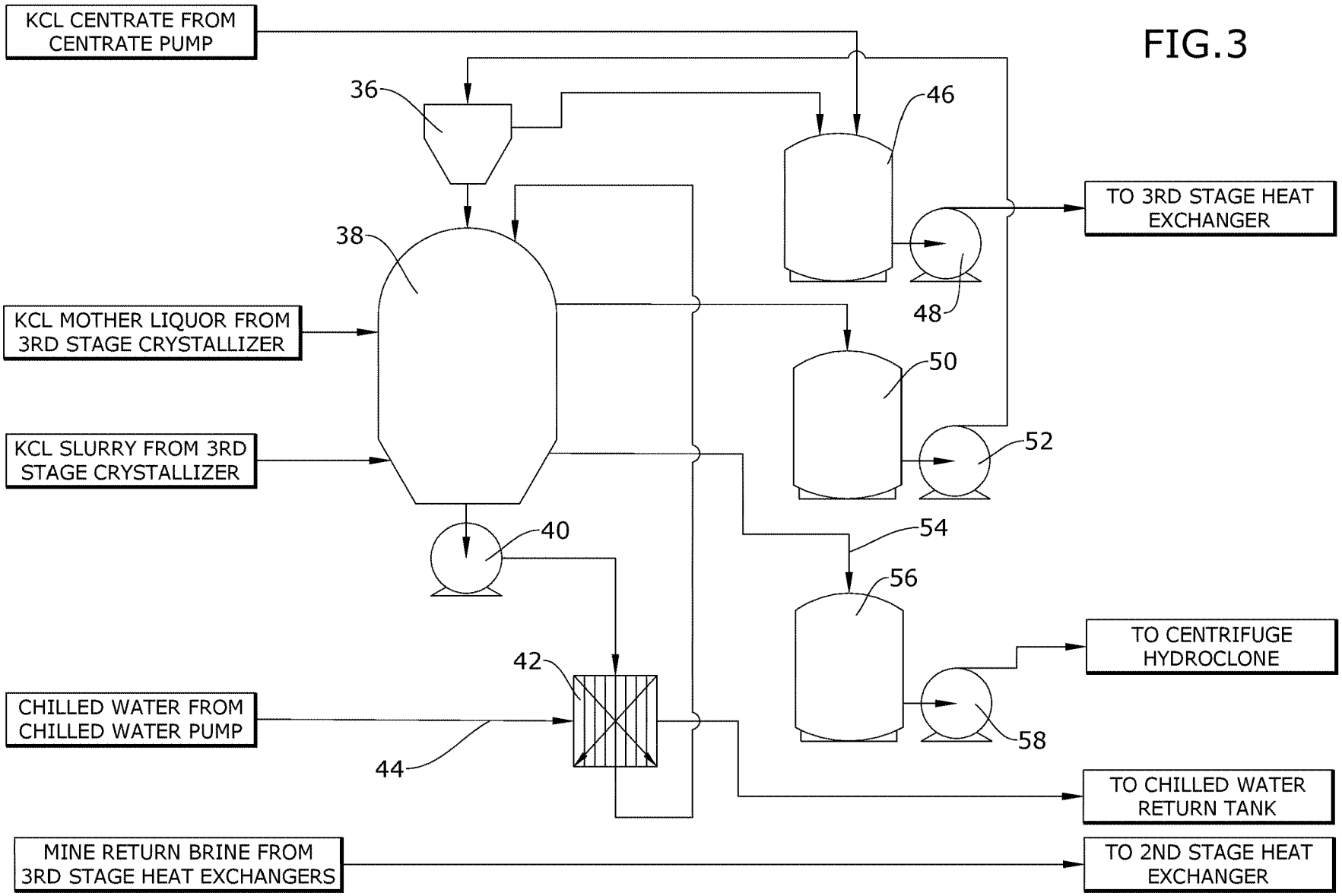
FIG. 3 is a schematic view of one embodiment of the present disclosure.

As mentioned above, the heated mine return brine may be pumped from the crystallizer feed tank 22 via a crystallizer feed pump 24 to a cooling crystallizer. As shown in FIG. 3, chilled water having a temperature of, for example, less than 5° C., may be used to chill the cooling crystallizer 38 contents, resulting in a decreased mineral (KCl) solution solubility of a solution flowing through a crystallizer exit stream 54 to a crystallizer slurry pump box 56. Contents from the crystallizer slurry pump box 56 may be pumped via a crystallizer slurry pump 58 to a mineral recovery device, such as a centrifuge hydroclone. More specifically, the system may include a cooling crystallizer 38, wherein a KCl weak liquor and a KCl slurry from a cooling crystallizer pump are fed into the cooling crystallizer heat exchanger 42 along with the chilled water from a chilled water circulation pump 70 to reduce the temperature of the crystallizer contents. The chilled water may have a temperature of about 5° C. and may function to chill the contents of the cooling crystallizer 38, resulting in a decreased KCl solution solubility in the crystallizer exit stream 54.

Figure 4:
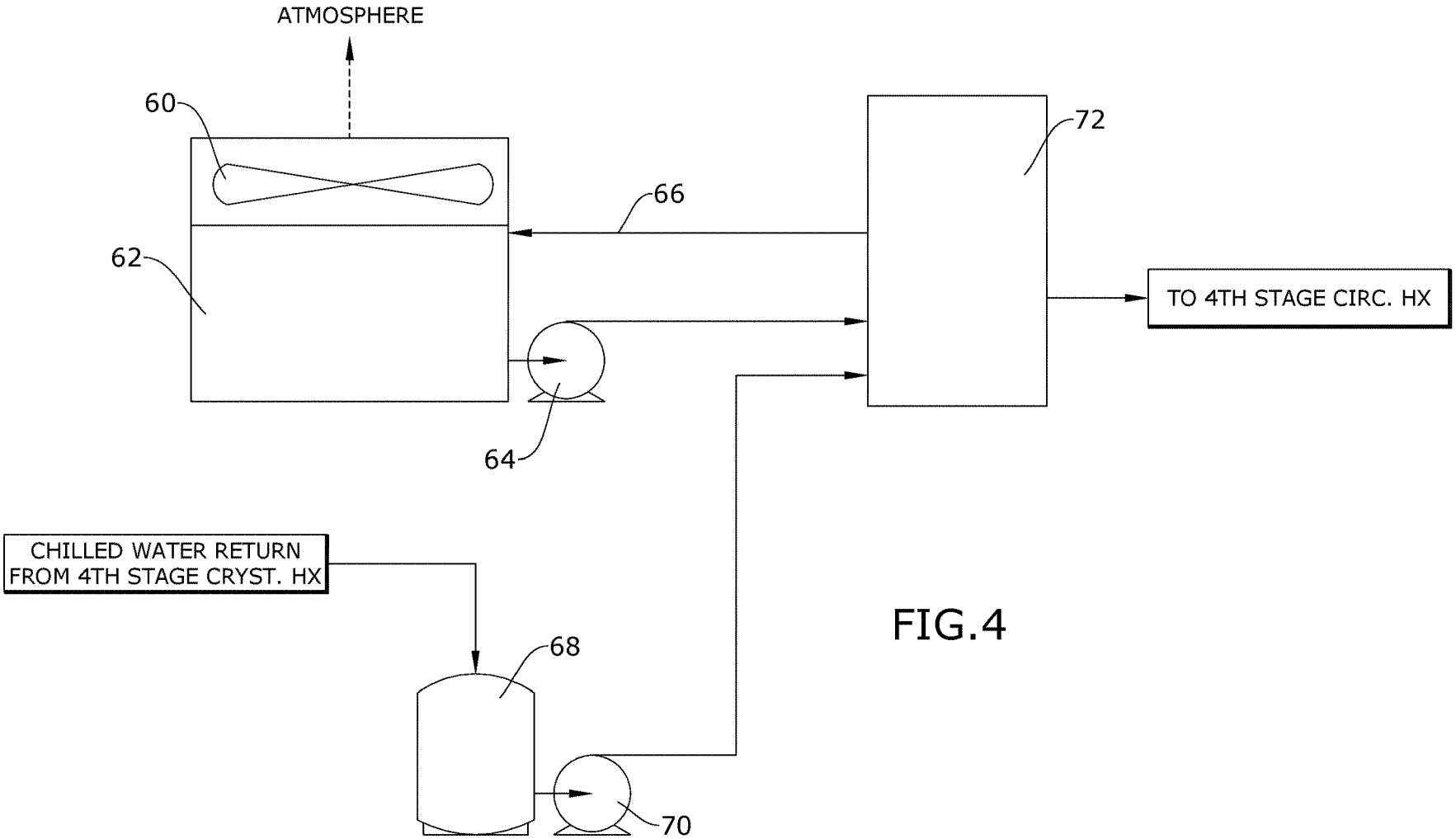
FIG. 4 is a schematic view of one embodiment of the present disclosure.

As shown in FIG. 4, the chilled water circulation exiting the cooling crystallizer heat exchanger returns to a chilled water return tank 68 and then to an absorption chiller or a mechanical chiller 72 via chilled water pump 70 for chilling to the desired chilled water temperature, which may be, for example between about −5° C. to about 5° C. In embodiments, the chillers may comprise absorption type chillers, mechanical type chillers, or a combination thereof. When used, an absorption chiller may use steam to provide the chilling energy, and a mechanical chiller may use electrical power for energy. In embodiments, the system may be designed to work for a combination of absorption and mechanical chillers and for a different number of cooling crystallizer stages.

Figure 5:
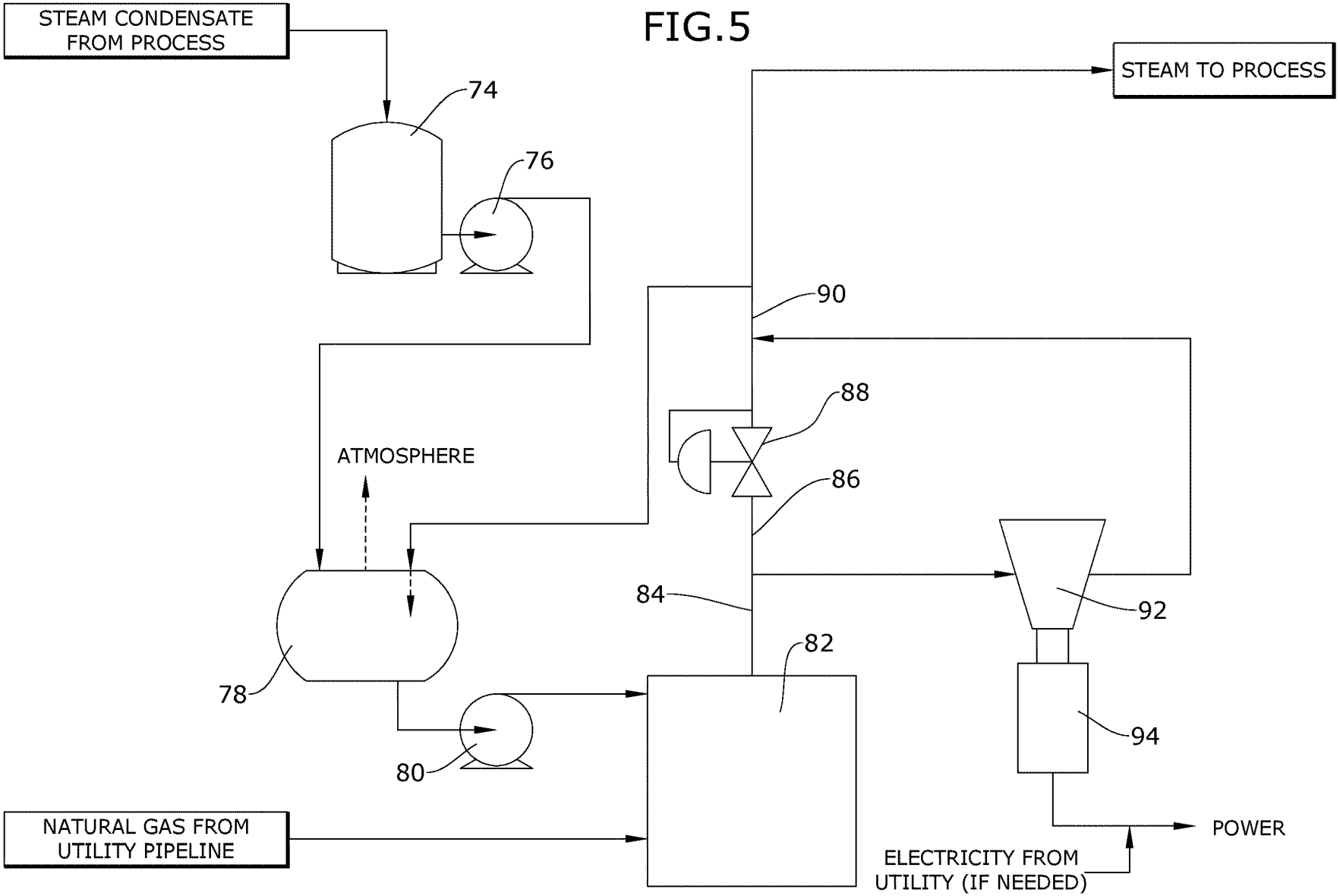
FIG. 5 is a schematic view of one embodiment of the present disclosure.

As shown in FIG. 5, the method may include the user of a cogeneration system using a steam turbine 92/generator 94 to generate steam and electrical power for the process. Steam for the steam turbine 92 is provided by a steam boiler 82 using natural gas for fuel. Steam condensate from the process is returned to the steam condensate tank 74 and is then pumped via the condensate return pump 76 to the boiler deaerator 78 and then pumped to the steam boiler 82 via boiler feed water pump 80. Superheated steam at a pressure of 50 bar (a) is produced in steam boiler 82 and the majority of the steam 95 is sent to the steam turbine 92 to generate power. Steam not needed for power generation, turbine bypass steam 86, is reduced to a pressure of 5 bar (a) via a pressure reducing valve 88 and then combines with the steam turbine exhaust steam 96 that is also at a pressure of 5 bar (a). For an absorption chiller case, cooling water from a cooling tower 62 with a cooling tower fan 60 is needed to regenerate the absorbent. Cooling water is sent to the absorption chiller 72 and returned to the cooling tower 62 using cooling tower pump 64. The use of an absorption chiller may provide additional steam for the turbine/generator, which may result in more power generation for the cogeneration system than the mechanical chillers. In fact, the system may be designed to generate 100% of the power requirements for the plant.

Figure 6:
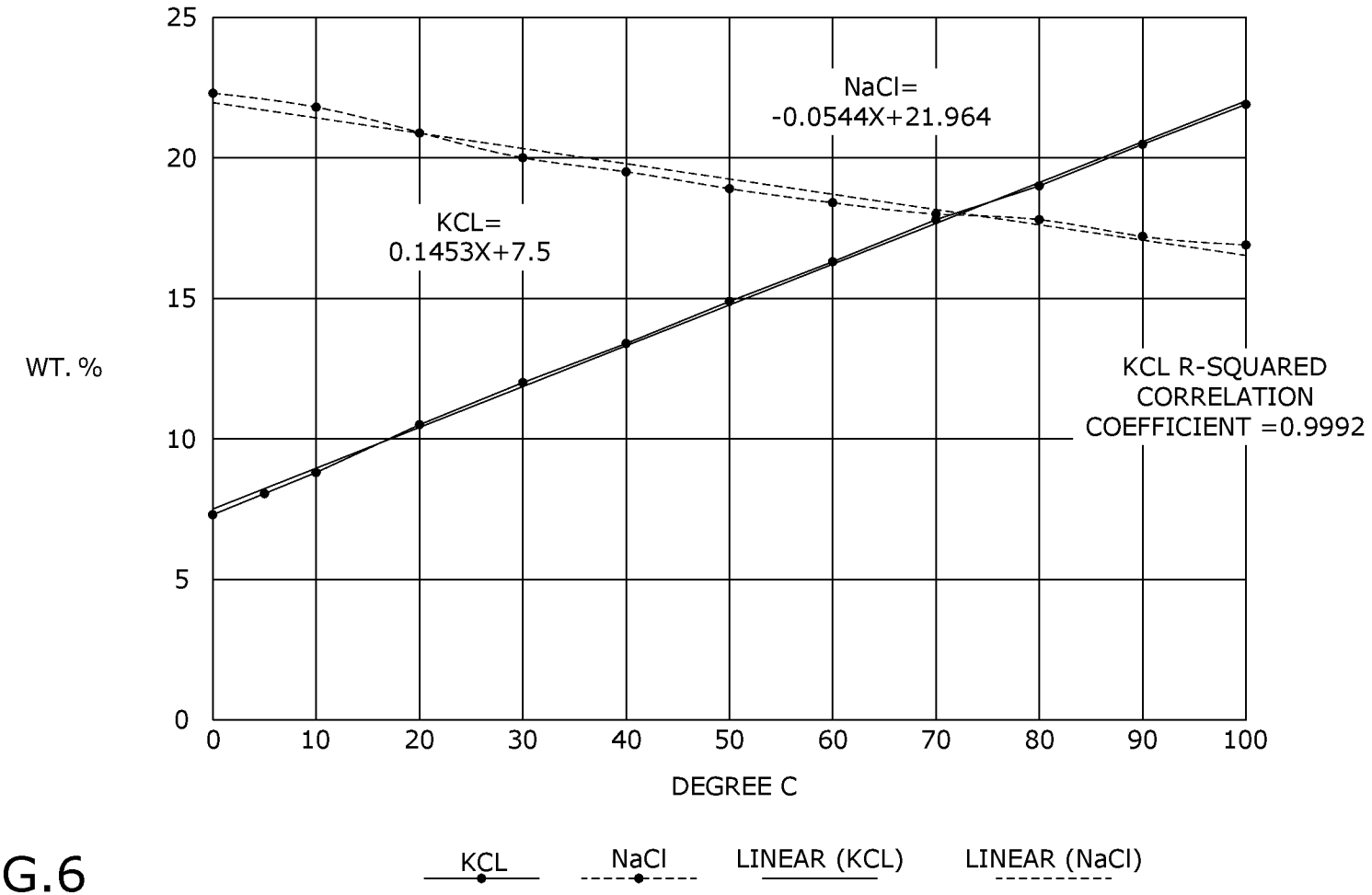
FIG. 6 is a graph showing KCl temperature versus concentration in a NaCl solution.

FIG. 6 shows the solubility relationship of KCl in solution with NaCl. The two minerals are typically found together and are known as sylvinite deposits. The KCl solubility limit has a normal relationship with temperature, and NaCl has a slight inverse relationship, meaning that the solubility goes down with increased temperature. Thus, as also shown in FIG. 6, reducing the final spent brine temperature and increasing the wellfield injection temperature increases the mineral (KCl) recovery rate. FIG. 6 also shows to what degree the temperature reduction and increase impacts recovery. For example, if the final brine temperature is 10° C. and the wellfield injection temperature is 80° C., the KCl solubility limit is 8.95 wt. % and 19.12 wt. % respectively as calculated by the correlation shown on FIG. 6. (KCl=0.453×X) where X equals the temperature of the solution in degrees C.). This produces a solubility difference of 10.17 wt. %. If the final brine temperature is 5° C. and the injection temperature is increased to 100° C., the KCl solubility limit is 8.23 wt. % and 22.03 wt. % respectively. This produces a solubility difference of 13.80 wt. %. The increased solubility difference for the second case results an increase of 35.69% ((13.80/10.17−1)×100). On a "per pass basis," this translates to a theoretical 35% reduction the wellfield/production plant circulation rate.

In actual operation, the production brine leaving the wellfield is at about 80% of the saturation limit at the temperature leaving the production brine wellhead. The temperature at the wellhead is less than the injection temperature leaving the plant due to pipe and cavern formation heat losses. Also, using a higher injection temperature leaving the plant will result in even higher temperature loss in the wellfield. However, as shown in Tables 1a and 1b below, even when these losses are considered, the reduction in the required circulation rate is approximately 27%.

TABLE 1a

Wellfield and Process Plant Circulation Rate vs. Temperature

| Case Description | Chiller Type | Brine Cir. Leaving Plant $m^3/h$ | Brine Cir. At Production Wellhead $m^3/h$ | Temp. Injection Brine at Wellhead ° C. | Temp Production Brine at Wellhead ° C. | Production Brine KCl wt. % |
|---|---|---|---|---|---|---|
| Base Case 100° C. Injection 5° C. Chiller | Mechanical | 1,169 | 1,140 | 99.0 | 61.5 | 12.72 |
| 120° C. Injection 0.0 ° C. Chiller | Mechanical | 864 | 833 | 118.8 | 69.8 | 13.65 |
| Base Case 100° C. Injection 5.0° C. Chiller | Absorption | 1,169 | 1,140 | 99.0 | 61.8 | 12.72 |
| 120° C. Injection 0.0° C. Chiller | Absorption | 865 | 834 | 118.8 | 69.8 | 13.65 |

TABLE 1b

Continuation of Table 1a

| Case Description | KCl Product Production Rate t/h (2) | Circulation Rate Reduction from Base Case % | Plant Power Requirement kW(4)(5) | Purchased Power kW | Boiler Steam Requirement t/h (1) | Opex Cost $USD/t (3) |
|---|---|---|---|---|---|---|
| Base Case 100° C. Injection 5° C. Chiller | 63.58 | N/A | 20,439 | 8,777 | 107 | 50.72 |

TABLE 1b-continued

Continuation of Table 1a

| Case Description | KCl Product Production Rate t/h (2) | Circulation Rate Reduction from Base Case % | Plant Power Requirement kW(4)(5) | Purchased Power kW | Boiler Steam Requirement t/h (1) | Opex Cost $USD/t (3) |
|---|---|---|---|---|---|---|
| 120° C. Injection 0.0° C. Chiller | 63.60 | 26.91 | 18,325 | 7,964 | 95 | 48.76 |
| Base Case 100° C. Injection 5.0° C. Chiller | 63.57 | N/A | 16,406 | 3,518 | 118 | 45.71 |
| 120° C. Injection 0.0° C. Chiller | 63.61 | 26.88 | 14,273 | 0.0 | 139 | 44.37 |

(1) Desuperheater produced steam subtracted.

(2) At 98.33% product purity (3) Nat. Gas price at $3.04 USD/gJ. Purchased power at $0.67 USD/kWh, Head count at 84 peoplefor managerial and operating staff.

(4) Mechanical Chiller assumes the ASHRE typical rate of 5.0 kW of chilling per kW of power input.

(5) Assumes Innovare Technical Ltd solution mining process for 500 TPA granular potash production Tables 1a and 1b were developed using a detailed mass and energy balance computer model for a 500,000 tons-per annum (TPA) selective solution mine process to produce Granular grade Muriate-Of-Potash (MOP). It includes a natural gas based cogeneration facility to produce steam and electrical power for the plant and mine. It also accounts for mineral and water accumulation in the wellfield caverns as solution mining takes place. Experimental use of the method of the present disclosure has provided an exponential increase in mineral solution mining with decreased injection brine mineral concentration. As a result, the method of the present disclosure results in a lower operative cost and a lower capital cost.

While the above description focuses mainly on the recovery of potash (KCl), the method of the present disclosure may be used to recover minerals that have a normal solubility relationship with temperature, meaning that an increased solution temperature produces an increased mineral solubility. For example, the recovered minerals may comprise potash (KCl), washing soda ($Na_2CO_3.10H_2O$), nahcolite ($NaHCO_3$), glauber salt ($NaSO_4.10H_2O$), tenardite ($Na_2SO_4$), globerite ($Na_2Ca(S)_4)_2$) and the borax minerals ($Na_2B_4O_7.10H_2O$) and ($Na_2B_4O_7.4H_2O$).

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A method for selective solution mining mineral recovery, the method comprising:

heating a wellfield injection brine to a temperature from about 100° C. to about 250° C.;

injecting the heated wellfield injection brine into an underground wellfield to dissolve soluble minerals therein, creating a hot brine solution;

removing the hot brine solution from the underground wellfield; and recovering the soluble minerals from the hot brine solution by cooling the hot brine solution to a temperature of from about −10° C. to about 5° C. and causing the soluble minerals to precipitate recovered minerals in a solid form.

2. The method of claim 1, wherein heating the wellfield injection brine comprises passing the wellfield injection brine through an injection heat exchanger.

3. The method of claim 1, wherein cooling the hot brine solution comprises using cooling crystallizers cooled with chiller water from a chiller.

4. The method of claim 3, wherein the chiller is selected from the group consisting of an absorption type chiller and a mechanical type chiller.

5. The method of claim 3, wherein cooling the hot brine solution comprises using multiple chillers, wherein the chillers comprise a combination of absorption and mechanical chillers.

6. The method of claim 1, wherein recovering the soluble materials further comprises concentrating the hot brine solution during recovery of the soluble using an evaporator.

7. The method of claim 1, wherein recovering the soluble materials comprises using multiple cooling crystallizers.

8. The method of claim 1, wherein the recovered minerals have a normal solubility relationship with temperature.

9. The method of claim 7, wherein the recovered minerals and selected from the group consisting of potash (KCl), washing soda ($Na_2CO_3.10H_2O$); nahcolite ($NaHCO_3$); glauber salt ($NaSO_4.10H_2O$) thenardite ($Na_2SO_4$); glauberite ($Na_2Ca(SO_4)_2$) and borax minerals ($Na_2B_4O_7.10H_2O$) and ($Na_2B_4O_7.4H_2O$).

* * * * *